US006729512B1

(12) United States Patent
Leighton

(10) Patent No.: US 6,729,512 B1
(45) Date of Patent: May 4, 2004

(54) RIBBON DISPENSER

(76) Inventor: James Bruce Leighton, 24634-56A Avenue, Langley, British Columbia (CA), V2Z 1H2

( * ) Notice: Subject to any disclaimer, the term of this patent is extended or adjusted under 35 U.S.C. 154(b) by 177 days.

(21) Appl. No.: 10/073,584

(22) Filed: Feb. 12, 2002

(51) Int. Cl.[7] ..... B26D 1/02; B65D 85/02

(52) U.S. Cl. ..... 224/269; 225/34; 225/35; 242/594.3; 242/598.5; 242/598.6

(58) Field of Search ..... 224/269; 221/121, 221/133; 225/34, 35, 36, 37, 38, 39, 46, 53; 242/594.3, 598.5, 598.6

(56) References Cited

U.S. PATENT DOCUMENTS 593,035 A * 11/1897 Springsteen ..... 225/34
2,031,033 A * 2/1936 Denebeim ..... 225/53
2,051,136 A * 8/1936 Dormire ..... 224/269
2,526,440 A * 10/1950 Toombs ..... 242/594.3
3,502,252 A * 3/1970 Mariani ..... 225/38
4,252,258 A * 2/1981 Plummer, III ..... 225/34
4,936,452 A * 6/1990 Pauley ..... 242/598.6
4,979,414 A * 12/1990 Caveney et al. ..... 225/34
5,022,577 A * 6/1991 Fike ..... 225/39
5,058,792 A * 10/1991 Morand ..... 225/53
5,718,365 A * 2/1998 Palmer ..... 225/38
6,273,309 B1 * 8/2001 Oppelt ..... 224/269
6,536,707 B2 * 3/2003 Adelakun ..... 242/598.6

* cited by examiner

*Primary Examiner*—Gary E. Elkins

(57) ABSTRACT

A ribbon dispenser for storing and dispensing selected lengths of safety ribbon for use by construction workers, particular. The ribbon dispenser includes a housing having side and end walls, and also having an open end; and also includes a cover being removably disposed over the open end of the housing; and further includes an elongate ribbon support member being disposed in the housing; and also includes a plurality of dividers being spaced apart and being disposed along the elongate ribbon support member; and further includes a dispenser support assembly being attached to the housing; and also includes a ribbon dispensing assembly being attached to the housing for removing selected lengths of ribbon from a roll of ribbon.

12 Claims, 2 Drawing Sheets

RIBBON DISPENSER

BACKGROUND OF THE INVENTION

1. Field of the Invention

The present invention relates to ribbon dispenser and more particularly pertains to a new ribbon dispenser for storing and dispensing selected lengths of safety ribbon for use by construction workers, particular.

2. Description of the Prior Art

The use of ribbon dispenser is known in the prior art. More specifically, ribbon dispenser heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 3,502,252; 4,979,414; Des. 298,513; 4,252,258; 5,482,182; and 3,635,383.

While these devices fulfill their respective, particular objectives and requirements, the aforementioned patents do not disclose a new ribbon dispenser. The prior art discloses inventions having housings, elongate support members disposed in the housings, cutting members for cutting tape being dispensed from the housings, and clip members for clipping to a user's person.

SUMMARY OF THE INVENTION

The general purpose of the present invention, which will be described subsequently in greater detail, is to provide a new ribbon dispenser which has many of the advantages of the ribbon dispenser mentioned heretofore and many novel features that result in a new ribbon dispenser which is not anticipated, rendered obvious, suggested, or even implied by any of the prior art ribbon dispenser, either alone or in any combination thereof. The present invention includes a housing having side and end walls, and also having an open end; and also includes a cover being removably disposed over the open end of the housing; and further includes an elongate ribbon support member being disposed in the housing; and also includes a plurality of dividers being spaced apart and being disposed along the elongate ribbon support member; and further includes a dispenser support assembly being attached to the housing; and also includes a ribbon dispensing assembly being attached to the housing for removing selected lengths of ribbon from a roll of ribbon. None of the prior art discloses a housing capable of string multiple rolls of ribbon, nor discloses an elongate ribbon guide member from guiding the ribbon to be severed from the roll.

There has thus been outlined, rather broadly, the more important features of the ribbon dispenser in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new ribbon dispenser which has many of the advantages of the ribbon dispenser mentioned heretofore and many novel features that result in a new ribbon dispenser which is not anticipated, rendered obvious, suggested, or even implied by any of the prior art ribbon dispenser, either alone or in any combination thereof.

Still another object of the present invention is to provide a new ribbon dispenser for storing and dispensing selected lengths of safety ribbon for use by construction workers, particular.

Still yet another object of the present invention is to provide a new ribbon dispenser that is easy and convenient to use.

Even still another object of the present invention is to provide a new ribbon dispenser that keeps the safety ribbon neatly stored and organized until needed.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
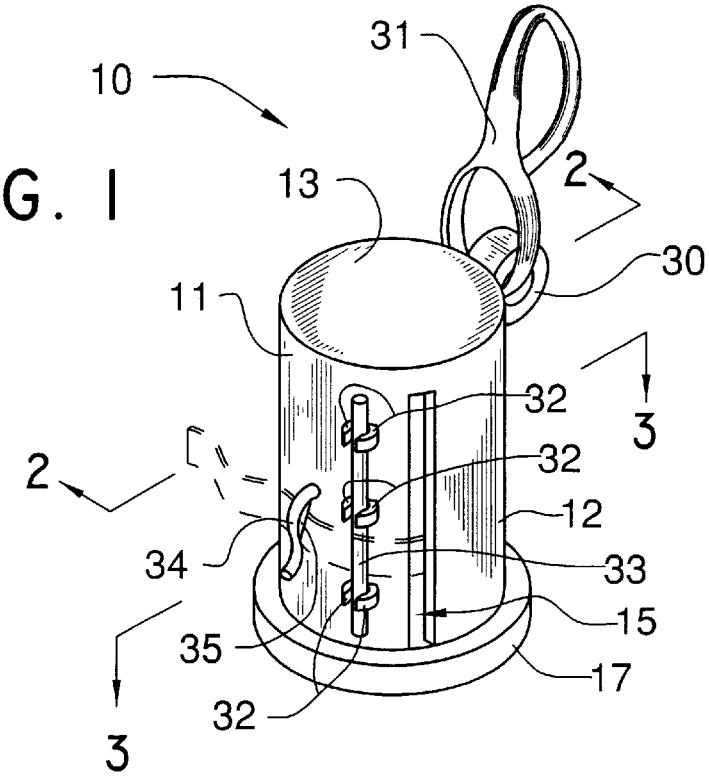
FIG. 1 is a perspective view of a new ribbon dispenser according to the present invention and shown in use.
Figure 2:
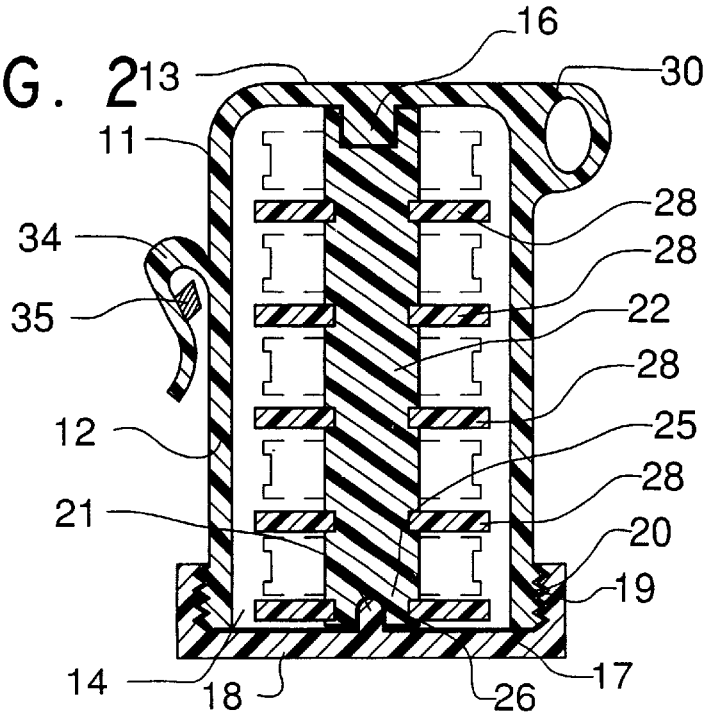
FIG. 2 is a longitudinal cross-sectional view of the present invention.
Figure 3:
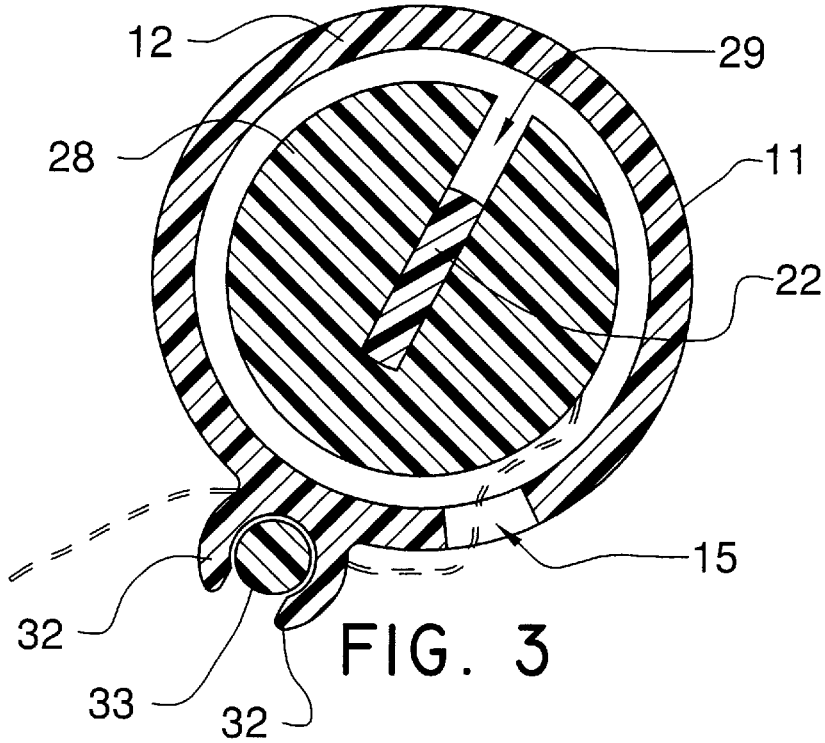
FIG. 3 is a lateral cross-sectional view of the present invention.
Figure 4:
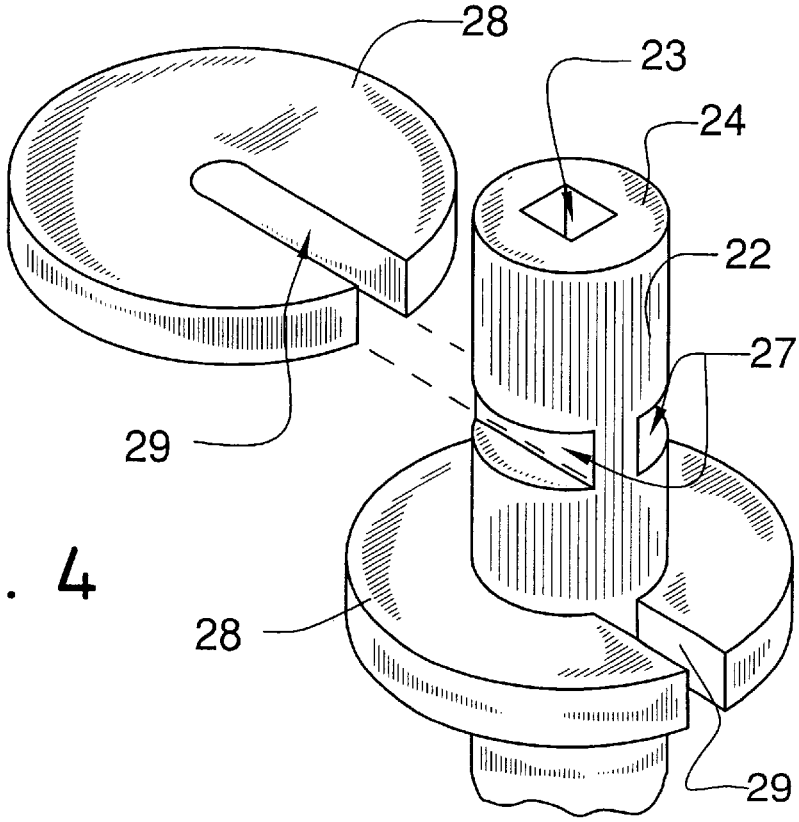
FIG. 4 is a partial exploded perspective view of the spindle and one of the dividers of the present invention

With reference now to the drawings, and in particular to FIGS. 1 through 4 thereof, a new ribbon dispenser embodying the principles and concepts of the present invention and generally designated by the reference numeral 10 will be described.

As best illustrated in FIGS. 1 through 4, the ribbon dispenser 10 generally comprises a housing 11 having side and end walls 12,13, and also having an open end 14. The housing 11 also includes a longitudinal slot 15 extending through the side wall 12 thereof and extending from the open end 14 to near the end wall 13 of the housing 11. The longitudinal slot 15 is adapted to dispense ribbon therethrough. The housing 11 further includes a multi-sided boss 16 being integrally attached to the end wall 13 inside the housing 11.

An elongate ribbon support member 22 is conventionally disposed in the housing 11. The elongate ribbon support member 22 includes a multi-sided slot 23 being disposed in a first end 24 thereof and being removably received in the multi-sided boss 16 to prevent the elongate ribbon support member 22 from rotating during the dispensing of ribbon. The elongate ribbon support member 22 has a notch 26 being disposed in a second end 25 thereof. The elongate ribbon support member 22 further includes a plurality of laterally-extended slots 27 being spaced apart and being disposed is a side thereof. The plurality of laterally-extended slots 27 include pairs of the laterally-extended slots; wherein, the laterally-extended slots of each pair thereof being diametrically-opposed to one another.

A cover 17 is removably disposed over the open end 14 of the housing 11. The cover 17 includes a main wall 18 and a perimeter wall 19 integrally depending from and along a perimeter of the main wall 18 and also having threads 20 being conventionally disposed upon an inner side thereof. The cover 17 is threaded upon the open end 14 of the housing 11. The cover 17 further includes a node member 21 being integrally disposed upon an inner side of the main wall 18 and being removably received in the notch 26 of the elongate ribbon support member 22.

A plurality of dividers 28 are spaced apart and are conventionally disposed along the elongate ribbon support member 22. The dividers 28 are disc-shaped members with each having a radial slot 29 being disposed through an edge thereof and removably receiving a portion of the elongate ribbon support member 22. Each of the disc-shaped members 28 is removably received in a respective one of the pairs of the laterally-extended slots 27.

A dispenser support assembly is conventionally attached to the housing 11. The dispenser support assembly includes a grommet 30 being securely and conventionally attached to an exterior of the housing 11, and also includes a belt clip member 31 being conventionally connected to the grommet 30 and being adapted to clip upon a user's belt. A ribbon dispensing assembly is attached to the housing 11 for removing selected lengths of ribbon from a roll of ribbon. The ribbon dispensing assembly includes a plurality of guide retaining members 32 being spaced apart and being securely and conventionally attached to an exterior of the housing 11, and also includes an elongate ribbon guide member 33 being removably and securely retained to the guide retaining members 32, and further includes a ribbon cutting member 34,35 being securely and conventionally attached to the exterior of the housing 11 for cutting selected lengths of ribbon from a roll of ribbon disposed in the housing 11. Each of the guide retaining members 32 are generally clips with each of the clips having opposed resilient jaws 32 being spaced apart for engaging about a portion of the elongate ribbon guide member 22. The ribbon cutting member 34,35 includes a sinusoidal-shaped blade support member 34 having an end being securely and conventionally attached to the exterior of the housing 11, and also includes a blade 35 being securely and conventionally attached to the sinusoidal-shaped blade support member 34 and being disposed being the sinusoidal-shaped blade member 34 and the housing 11 for cutting selected length of ribbons from a roll of ribbon being disposed in the housing 11.

In use, the user can load reels of ribbon in the housing 11 about the elongate ribbon support member 22 and being separated by the dividers 28 with an end piece of the ribbon being extended through the longitudinal slot 15 in the housing 11 and under the elongate ribbon guide member 33. When the user needs a selected length of ribbon, the user pulls out the ribbon from the housing 11 and severs the selected piece of ribbon using the blade 35. The user can easily clip the ribbon dispenser 10 to one's belt.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the ribbon dispenser. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A ribbon dispenser comprising:

a housing having side and end walls, and also having an open end, said housing also including a longitudinal slot extending through said side wall thereof and extending from said open end to near said end wall of said housing, said longitudinal slot being adapted to dispense ribbon therethrough;

a cover being removably disposed over said open end of said housing;

an elongate ribbon support member being disposed in said housing;

a plurality of dividers being spaced apart and being disposed alone said elongate ribbon support member;

a dispenser support assembly being attached to said housing; and a ribbon dispensing assembly being attached to said housing for removing selected lengths of ribbon from a roll of ribbon.

2. A ribbon dispenser as described in claim 1, wherein said housing further includes a multi-sided boss being attached to said end wall inside said housing.

3. A ribbon dispenser as described in claim 2, wherein said elongate ribbon support member includes a multi-sided slot being disposed in a first end thereof and being removably received in said multi-sided boss to prevent said elongate ribbon support member from rotating during the dispensing of ribbon.

4. A ribbon dispenser as described in claim 3, wherein said elongate ribbon support member has a notch disposed in a second end thereof.

5. A ribbon dispenser as described in claim 4, wherein said elongate ribbon support member further includes a plurality of laterally-extended slots being spaced apart and being disposed is a side thereof.

6. A ribbon dispenser as described in claim 5, wherein said plurality of laterally-extended slots include pairs of said laterally-extended slots; wherein said laterally-extended slots of each said pair of said laterally-extended slots being diametrically-opposed to one another.

7. A ribbon dispenser as described in claim 4, wherein said cover includes a main wall and a perimeter wall depending from and along a perimeter of said main wall and also having threads disposed upon an inner side thereof, said cap being threaded upon said open end of said housing.

8. A ribbon dispenser as described in claim 7, wherein said cover further includes a node member being disposed upon an inner side of said main wall and being removably received in said notch of said elongate ribbon support member.

9. A ribbon dispenser as described in claims 7, wherein said dividers are disc-shaped members with each having a radial slot being disposed through an edge thereof and removably receiving a portion of said elongate ribbon support member, each of said disc-shaped members being removably received in a respective one of said pairs of said laterally-extended slots.

10. A ribbon dispenser comprising:

a housing having side and end walls, and also having an open end;

a cover being removably disposed over said open end of said housing;

an elongate ribbon support member being disposed in said housing;

a plurality of dividers being spaced apart and being disposed along said elongate ribbon support member;

a dispenser support assembly being attached to said housing; and a ribbon dispensing assembly being attached to said housing for removing selected lengths of ribbon from a roll of ribbon, said ribbon dispensing assembly including a plurality of guide retaining members being spaced apart and being securely attached to an exterior of said housing, and also including an elongate ribbon guide member being removably and securely retained to said guide retaining members, and further including a ribbon cutting member being securely attached to the exterior of said housing for cutting selected lengths of ribbon from a roll of ribbon disposed in said housing.

11. A ribbon dispenser as described in claim 10, wherein each of said guide retaining members are generally clips with each of said clips having opposed resilient jaws being spaced apart for engaging about a portion of said elongate ribbon guide member.

12. A ribbon dispenser as described in claim 11, wherein said ribbon cutting member includes a sinusoidal-shaped blade support member having an end being securely attached to the exterior of said housing, and also includes a blade being securely attached to said sinusoidal-shaped blade support member and being disposed being said sinusoidal-shaped blade member and said housing for cutting selected length of ribbons from a roll of ribbon being disposed in said housing.

* * * * *